US009879929B2

(12) United States Patent
Leimer

(10) Patent No.: US 9,879,929 B2
(45) Date of Patent: Jan. 30, 2018

(54) SLIDE FOR A RIFLE

(71) Applicant: L&O Hunting Group GmbH, Isny (DE)

(72) Inventor: Jan Leimer, Mestecko Trnavka (CZ)

(73) Assignee: L&O HUNTING GROUP GMBH, Isny (DE)

( * ) Notice: Subject to any disclaimer, the term of this patent is extended or adjusted under 35 U.S.C. 154(b) by 0 days.

(21) Appl. No.: 15/156,467

(22) Filed: May 17, 2016

(65) Prior Publication Data

US 2016/0341500 A1 Nov. 24, 2016

(30) Foreign Application Priority Data

May 22, 2015 (DE) ..... 10 2015 108 125

(51) Int. Cl.

| | |
|---|---|
| ***F41A 3/34*** | (2006.01) |
| ***F41A 3/12*** | (2006.01) |
| ***F41A 3/72*** | (2006.01) |
| ***F41A 5/18*** | (2006.01) |
| *F41A 21/48* | (2006.01) |

(52) U.S. Cl.

CPC ..... *F41A 3/34* (2013.01); *F41A 3/12* (2013.01); *F41A 3/72* (2013.01); *F41A 5/18* (2013.01); *F41A 21/485* (2013.01)

(58) Field of Classification Search

CPC ..... F41A 3/12; F41A 3/34; F41A 3/72; F41A 3/14; F41A 5/18; F41A 21/485

USPC ..... 42/16

See application file for complete search history.

(56) References Cited

U.S. PATENT DOCUMENTS

| | | | | |
|---|---|---|---|---|
| 1,363,262 | A * | 12/1920 | North | F41A 21/484 42/75.02 |
| 2,077,415 | A * | 4/1937 | House | F41A 3/46 89/187.01 |
| 2,373,213 | A * | 4/1945 | Williams | F41A 3/68 42/20 |
| 3,200,710 | A | 8/1965 | Kelly et al. | |
| 3,675,534 | A * | 7/1972 | Beretta | F41A 3/26 42/138 |
| 3,816,950 | A * | 6/1974 | Vesamaa | F41A 3/72 42/16 |

(Continued)

FOREIGN PATENT DOCUMENTS

| | | |
|---|---|---|
| DE | 19836964 | 12/1999 |
| DE | 202004006496 | 9/2005 |
| EP | 0896198 A2 | 2/1999 |

OTHER PUBLICATIONS

Result of examination report for German Application No. 10 2015 108 125.3 filed May 22, 2015.

European Search Report dated Sep. 30, 2016 for EP 3 096 107.

*Primary Examiner* — Joshua E Freeman

(74) *Attorney, Agent, or Firm* — Paul D. Bianco; Katherine Davis; Fleit Gibbons Gutman Bongini & Bianco PL

(57) ABSTRACT

A slide for a rifle with a slide operating mechanism, which is movable in the longitudinal direction of the rifle, and a slide element, which can be moved by the slide operating mechanism between a locked position and an unlocked position. The slide operating mechanism is connected to the slide element via a control element, which is movable transversely to the slide element and is designed as a connector that cooperates with the slide element for its displacement between the upper, locked position and the lower, unlocked position.

20 Claims, 7 Drawing Sheets

(56) References Cited

U.S. PATENT DOCUMENTS

| | | | | | |
|---|---|---|---|---|---|
| 4,014,247 | A * | 3/1977 | Tollinger | F41A 9/18 | 42/17 |
| 4,161,836 | A | 7/1979 | Hayashi | | |
| 5,913,262 | A * | 6/1999 | Keppeler | F41A 3/34 | 89/186 |
| 6,276,256 | B1 * | 8/2001 | Kimmig | F41A 3/34 | 89/186 |
| 7,469,624 | B1 * | 12/2008 | Adams | F41A 5/26 | 89/191.01 |
| 9,534,860 | B2 * | 1/2017 | Leimer | F41A 5/26 | |
| 2007/0131104 | A1 * | 6/2007 | Botty | F41A 3/26 | 89/193 |
| 2010/0300278 | A1 * | 12/2010 | Zedrosser | F41A 3/26 | 89/180 |
| 2014/0059910 | A1 * | 3/2014 | Norton | F41A 3/26 | 42/9 |

* cited by examiner

SLIDE FOR A RIFLE

FIELD OF THE DISCLOSURE

The disclosure relates to a slide for a rifle and a rifle with such a slide.

BACKGROUND

A gas-operated semiautomatic rifle known under the name of Sauer 303 contains a slide with a slide operating mechanism, which is movable in the longitudinal direction of the rifle, and a slide element, which is movable by the slide operating mechanism between a locked and unlocked position. The slide element in this known rifle consists of a chamber provided with locking tabs, which can be moved by rotation about its longitudinal axis between a locked position and an unlocked position. Rotation of the chamber occurs via a guide sleeve, which can be moved in the longitudinal direction via two parallel push rods.

SUMMARY OF THE DISCLOSURE

A slide and a rifle with such a slide, which permits simple disassembly and assembly of the slide, are disclosed.

Expedient modification and advantageous embodiments are also disclosed.

The slide element in the slide according to the disclosure is not rotated about its longitudinal axis for movement between a locked and unlocked position, but pushed between an upper, locked position and a lower, unlocked position. For movement of the slide element between an upper, locked position and a lower, unlocked position, the slide operating mechanism is connected to the slide element via a control element, which is movable transversely to the slide element and is designed as a connector. The control element can therefore be simply pulled out or reinserted so that disassembly and assembly of the slide is significantly simplified.

The control element, which is designed as a connector and is movable transversely to the slide element for assembly and disassembly, cooperates, in a preferred embodiment, with an unlocking ramp on the slide element for its movement from the upper, locked position into the lower, unlocked position.

The control element can advantageously be designed in the form of a simply insertable and also easily disassembled pin. A slide handle can also be arranged on the control element. The control element can thereby be simply pulled out and the slide simply disassembled, as required. The control element can also form a part of the slide handle, so that the number of required parts can be reduced.

The slide operating mechanism preferably has two parallel push rods, between which the control element is releasably arranged. A disassembly safety can expediently be arranged in one of the push rods for secure holding of the control element and to prevent undesired disassembly. The disassembly safety can contain a safety pin arranged at right angles to the control element, which can be moved between a safety position that secures the control element and a disassembly position that releases the control element.

The unlocking ramp cooperating with the control element can expediently be arranged on a control opening running across the slide element, through which the control element runs.

Movement of the slide element into the locked position can also be controlled by the control element. However, other control elements for movement into the locked position can also be arranged on the slide element. The slide element, for example, can also contain laterally protruding shoulders, which cooperate with locking ramps on the push rods of the slide operating mechanism for movement of the slide element into the locked position.

A radially movable cartridge holder can be arranged on the slide element. The shell casing can also be held precisely at the height of the chamber in particularly expedient fashion by the cartridge holder when the slide element is moved transversely to the longitudinal axis of the barrel from the upper, locked position into the lower, unlocked position.

The disclosure also relates to a rifle containing a receiver or slide housing, a rifle barrel releasably fastened to the slide housing and the already described slide. The slide operating mechanism of the slide can be guided to move between upper guide surfaces on the slide housing and lower guide surfaces on the rifle barrel.

The rifle barrel can expediently contain a rear part, which can be mounted on the slide housing and can be firmly connected thereto, and a front part extending freely from the slide housing without firm connection to a front shaft only fastened to the slide housing. The barrel can thereby be simply taken out upwardly for disassembly without previous disassembly of the front shaft. No connections on the front side of the barrel need be loosened, and the barrel need not be pulled out of a barrel mount. For assembly, the barrel can merely be simply positioned on the side housing and connected thereto. Simpler separability of the semiautomatic rifle can therefore be achieved.

BRIEF DESCRIPTION OF THE FIGURES

Additional details and advantages of the disclosure are apparent from the following description of the preferred exemplary embodiment with reference to the drawing. In the drawing.

DETAILED DESCRIPTION

Figure 1:
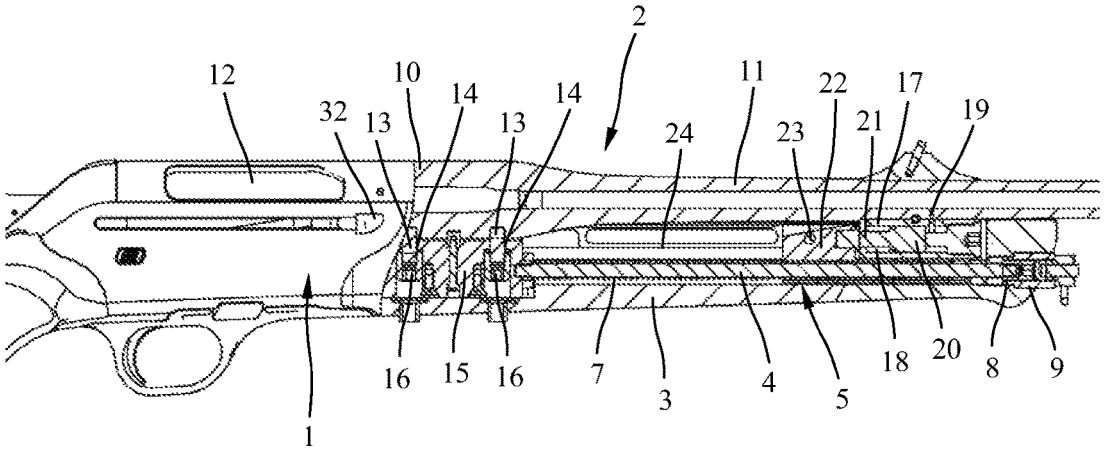
FIG. 1 shows a partial longitudinal section of a rifle with a slide housing and part of a rifle barrel.

A partial longitudinal section of a rifle designed here as a gas-operated semiautomatic rifle with a receiver or slide housing 1, a rifle barrel 2 fastened on slide housing 1 and a front shaft 3 is shown in FIG. 1. Guide rod 4, which is parallel to the axis of the bore of the rifle barrel that protrudes forward when viewed in the firing direction, is fastened on the slide housing 1. A slide operating mechanism 5 for movement of a slide element 6 is guided to move on the guide rod 4 not fastened to rifle barrel 2 and protruding freely forward, depicted in different perspectives in FIGS. 2 and 3 and further explained below. A slide spring 7 is also arranged on the guide rod 4, via which the slide operating mechanism 5 is pushed forward. The front shaft 3 with its front end viewed in the firing direction is fastened to the guide rod 4 via outside thread 8 on the front free end of guide rod 4 and a threaded sleeve 9 provided with inside thread.

As follows from FIG. 1, the rifle barrel 2 has a rear part 10, which can be mounted on the slide housing 1 and can be firmly connected thereto, and a front part 11 freely protruding from the slide housing 1. An ejection opening 12 for ejection of casings is provided on the rear part 10 of rifle barrel 2 enlarged in diameter relative to the front part 11. The rear part 10 and the front part 11 of the rifle barrel 2 viewed in the firing direction are made from a single piece in the depicted variant. The two parts 10 and 11 of the rifle barrel 2, however, can also be made in individual parts, assembled and firmly connected to each other, for example, by soldering or another appropriate method of connection.

Two radially protruding mounting pins 13 are provided on the rear part 10 of barrel 2 lying on the slide housing 1 for fastening of the rifle barrel 2 to the slide housing 1. Mounting pins 13 provided with exterior threads can be readily inserted into the rear part 10 of the rifle barrel 2 or directly molded onto the rifle barrel 2. The mounting pins 13 are designed for engagement in two holes 14 arranged next to each other in a protruding support part 15 of the slide housing 1. The rifle barrel 2 can be fastened via the two mounting pins 13 to the slide housing 1 with its front part 11 freely protruding forward by two nuts 16 accessible from the bottom of the slide housing 1. The rear end of the front shaft 3 is also fastened to the support part 15 of the slide housing 1. A downwardly protruding gas extraction block 17 is provided in the center area of the barrel 2 on front part 11.

It is shown in FIG. 1 that the gas extraction block 17 has a gas cylinder 18 with a gas extraction hole 19 that extends into the barrel 2 and a piston 20 that is axially guided to move in the gas cylinder 18. The piston 20 contains piston rod 21 extending to a rear hole in the gas extraction block 17, which cooperates with the slide operating mechanism 5 for its movement in the longitudinal direction of the rifle.

Figure 2:
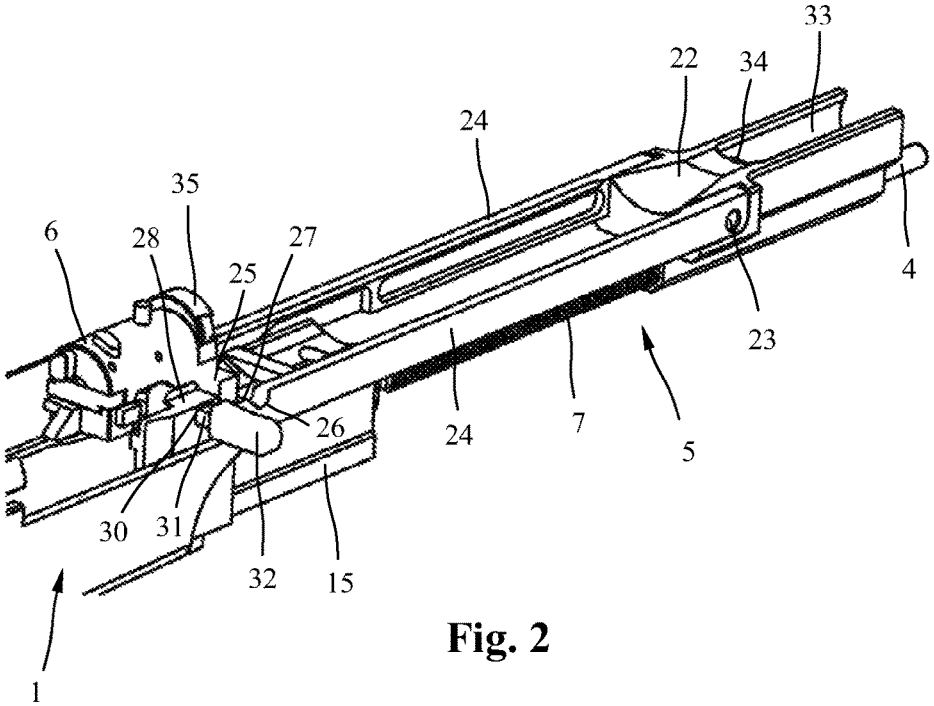
FIG. 2 shows a slide of the rifle depicted in FIG. 1 with a slide operating mechanism and a slide element in a perspective view.
Figure 3:
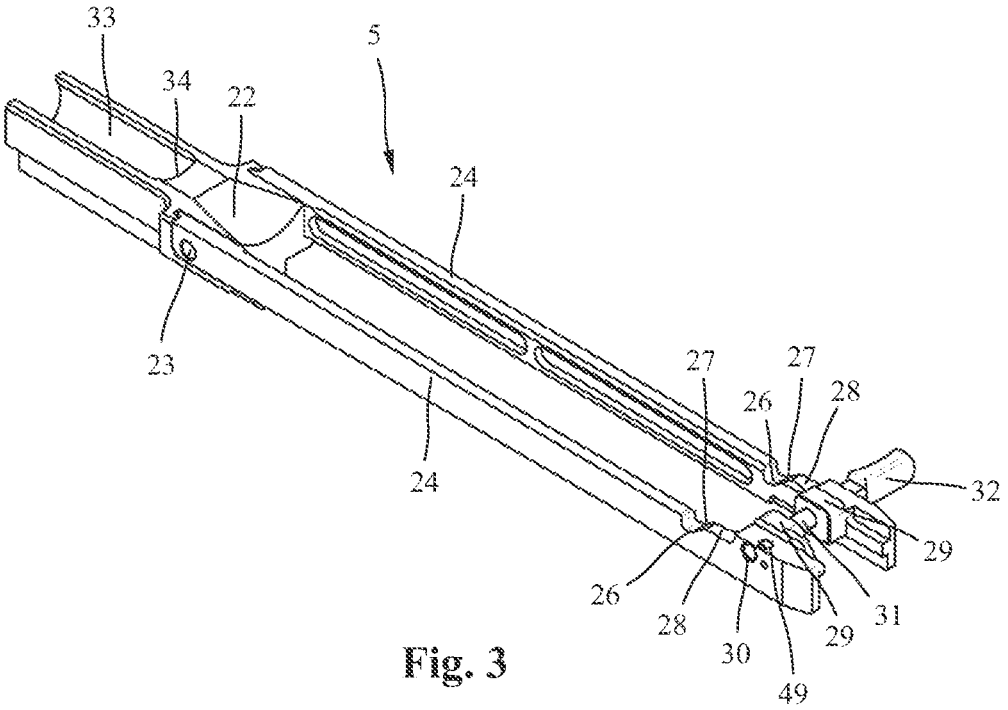
FIG. 3 shows the slide operating mechanism of the slide depicted in FIG. 2 in a perspective view.

The slide operating mechanism 5 depicted separately in FIGS. 2 and 3 includes a support 22 guided to move on the guide rod 4 and two push rods 24 fastened on support 22 via a cross pin 23. On the rear, free ends of the two rail-like push rods 24, viewed in the firing direction, are a control cam that cooperates with lateral shoulders 25 on the slide element 6 with a recess 26, a locking ramp 27 that runs upward obliquely, and an upper control surface 28 that is provided on top. The push rods 24, designed as rails, have opposite thickenings 29 in the rear end area with transverse holes 30 for control element 31, designed here as a cross pin. A laterally protruding slide handle 32 is molded onto the pin-like control element 31. The support 22 has a U-shaped cross section on its front part, viewed in the firing direction, with a receptacle 33 and a rear support 34 for the piston rod 21 of piston 20. The gas extraction block 17 is easily insertable during assembly of the rifle barrel 2 into the upward, open receptacle 33 of support 22.

Figure 4:
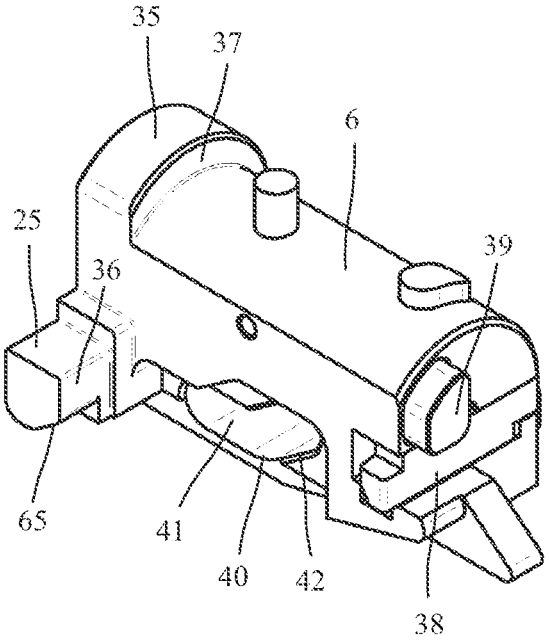
FIG. 4 shows the side element of the slide depicted in FIG. 2 in a perspective view.

The slide element 6 is shown in FIG. 4. In addition to the laterally protruding shoulders 25, it has upwardly protruding locking block 35. Rear locking surfaces 36 and 37 are provided on the two shoulders 25 and the locking block 35. An impact plate 38 and an ejector 39 are also arranged on the rear side of the slide element 6. A continuous control element 40 with a lower control surface 41 and an unlocking ramp 42 running obliquely upward passes transversely through the slide element 6.

Figure 5:
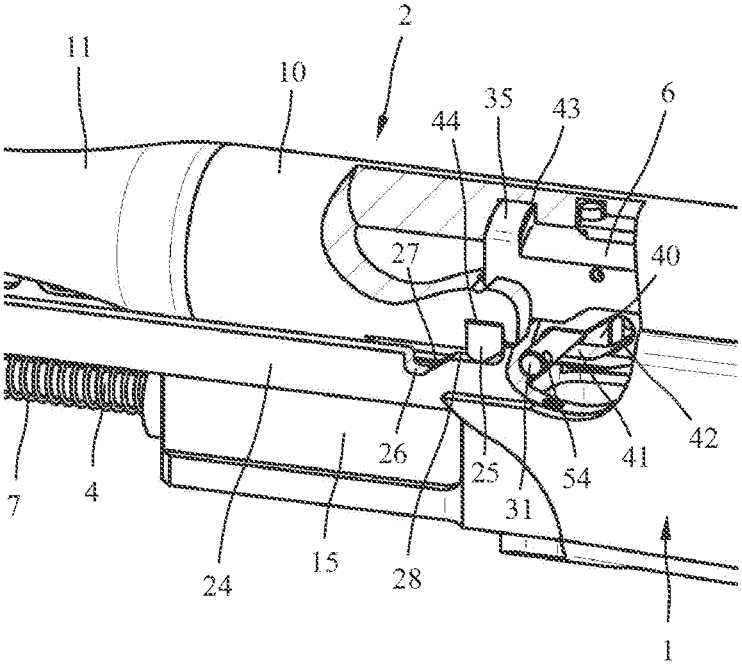
FIG. 5 shows a partial view of the rifle of FIG. 1 with the slide in a locked position.
Figure 6:
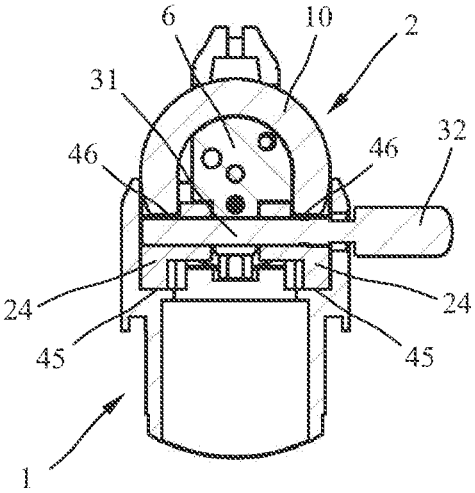
FIG. 6 shows a cross section of the rifle of FIG. 1 with the slide in a locked position.
Figure 7:
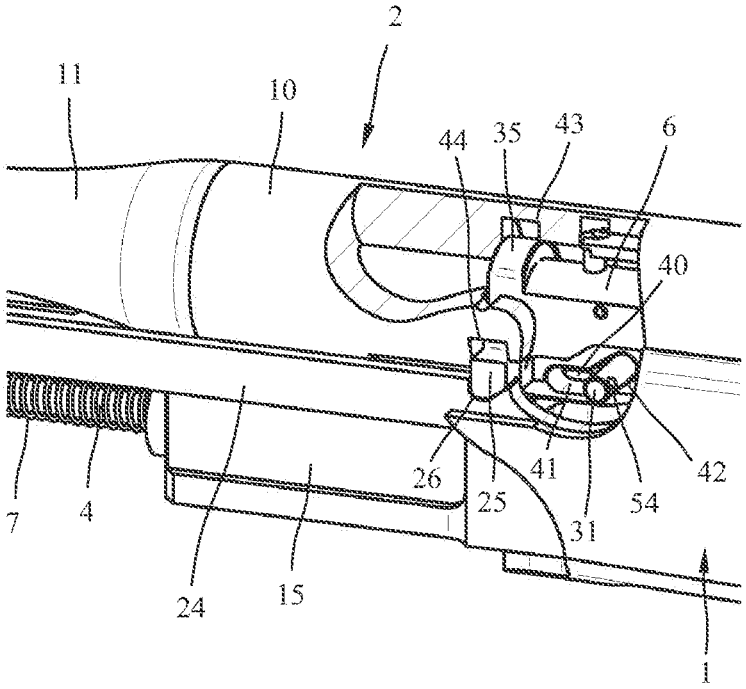
FIG. 7 shows a partial view of the rifle of FIG. 1 with the slide in an unlocked position.
Figure 8:
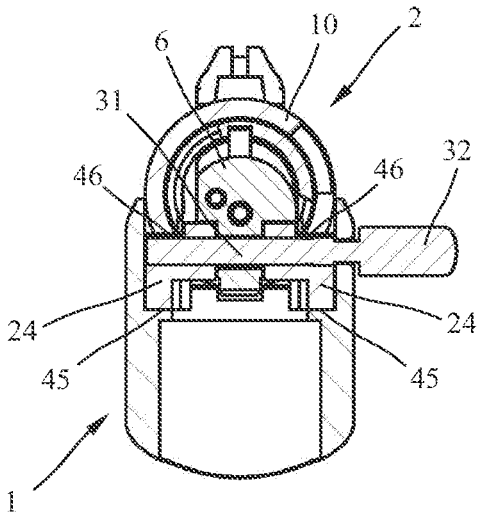
FIG. 8 shows a cross section of the rifle of FIG. 1 with the slide in an unlocked position.

By displacement of the slide operating mechanism 5, as shown in FIG. 3 in the longitudinal direction of the semi-automatic weapon, the slide element 6 depicted in FIG. 4 can be moved between an upper, locked position depicted in FIGS. 5 and 6 and a lower, unlocked position depicted in FIGS. 7 and 8.

In the locked position depicted in FIGS. 5 and 6, the support 22 (not apparent here) and the push rods 24 of the slide operating mechanism 5 depicted separately in FIG. 3 and guided to move on the guide rod 4 are forced forward (to the left in FIG. 5), when viewed in the firing direction, by the slide spring 7 tightened between the support part 15 of the slide housing 1 and support 22. In this position, the slide element 1 with its two shoulders 25 lies on the upper control surface 28 of push rods 24, and the locking block 15 on slide element 6 engages in a locking groove 43 on the rifle barrel 2. The lateral shoulders 25 also engage in lateral grooves 44 on the bottom of the tunnel-like and downward, open rear barrel part 12. Secure holding of the slide element 6 in the rifle barrel 2 is thereby achieved in the locked position. The pin-like control element 31 extending through control opening 40 in the locked position lies on the lower control surface 41 of control opening 40.

If, on the other hand, the slide operating mechanism 5 is pushed rearward, when viewed in the firing direction, against the force of the slide spring 7, either via the slide handle 32 or the gas pressure during release of a shot, the slide element 6 is moved downward into the locked position depicted in FIGS. 7 and 8 via the pin-like control element 31 and the unlocking ramp 42 on the passage opening 40 of the slide element 6. In the lower, unlocked position, the lateral shoulders 25 are disengaged from the lateral grooves 44 and lie in the recess 26 of the push rods 24. The slide block 35 of the slide element 6 is also disengaged from the locking groove 43 on rifle barrel 2, so that the slide element 6 can move farther rearward. The cartridge casing can then be pulled out of the chamber by means of an injector 55, depicted in FIG. 14, arranged on the front of the slide element 6 and ejected through the ejection opening 12 via the ejector 39, depicted in FIG. 4.

It is apparent in FIGS. 6 and 8 that slide operating mechanism 5 is guided to move via the strip-like push rods 24 between upper guide surfaces 45 on receiver or slide housing 1 and lower guide surfaces 46 on the rear part 12 of rifle barrel 2. In the depicted embodiment, the slide handle 32 is designed in one piece with the pin-like control element 31. Control element 31 and the slide handle 32, however, can also be designed as separate parts that are firmly connected to each other.

Figure 9:
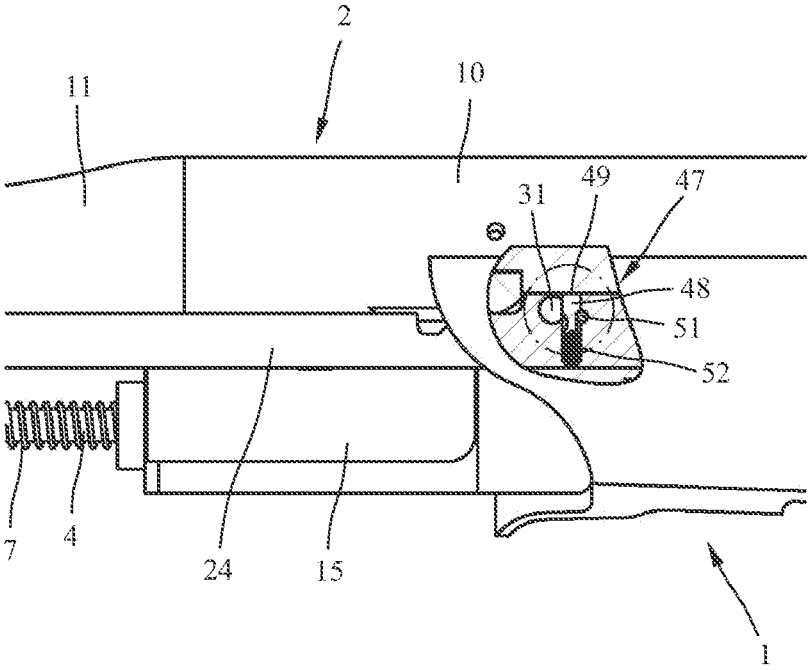
FIG. 9 shows a disassembly safety of the rifle of FIG. 1.
Figure 10:
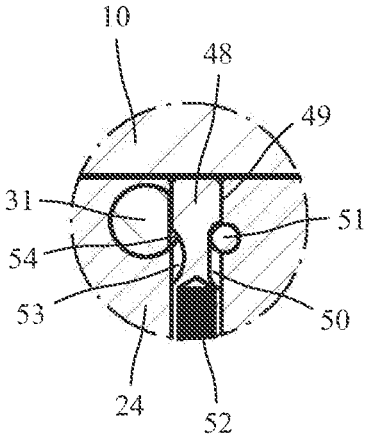
FIG. 10 shows an enlarged depiction of the disassembly safety of FIG. 9 in a safety position.
Figure 11:
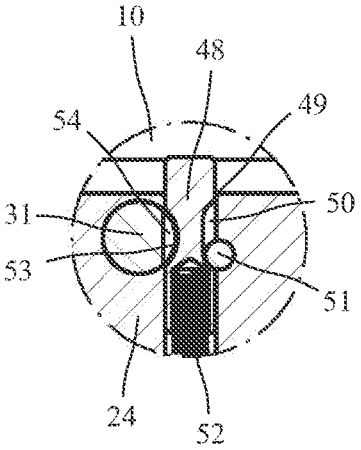
FIG. 11 shows an enlarged depiction of the disassembly safety of FIG. 9 in a disassembly position.

On the rear end of the left push rod 24 of the slide operating mechanism 5, viewed in the firing direction, a disassembly safety 47, further shown in FIGS. 9 to 11, is arranged for secure holding and prevention of undesired disassembly of the pin-like control element 31. Disassembly safety 47 includes a safety pin 48 arranged at right angles to the pin-like control element 31, which is arranged in a blind hole 49 open toward the top of push rod 24, also depicted in FIG. 3, on the rear end of the left push rod 24, viewed in the firing direction.

As follows from FIGS. 10 and 11, the safety pin 48 is guided to move within the blind hole 49 via a lateral longitudinal groove 50 and a holding pin 51 perpendicular thereto between a lower safety position depicted in FIG. 10 and an upper disassembly position depicted in FIG. 11 and is forced upwardly into the disassembly position by a compression spring 52. The safety pin 48 has an indentation 53 on its side opposite longitudinal groove 50 with a radius adapted to the outer contour of the control element 31. The pin-like control element 31 also contains an indentation 54 facing safety pin 48 on its end opposite the slide handle 32, which is also shown in FIGS. 5 and 7. When the rifle barrel 2 is mounted, the safety pin 48 is forced into the lower safety position of FIGS. 9 and 10 from the rear part 12 of the rifle barrel 2. The indentation 53 is arranged on the safety pin 48 so that it is situated in the lower safety position of safety pin 48 beneath the center axis of the pin-like control element 31, and the safety pin 48 engages with its cylindrical upper end in the indentation 54 of the pin-like control element 31. Thus, pulling out of the pin-like control element 31 is prevented in the lower safety position of the safety pin 48. Only when the rifle barrel 2 is removed can the safety pin 48 reach the disassembly position depicted in FIG. 11 through the compression spring 52. The indentation 53 is arranged in the safety pin 48 so that it lies at the level of the center axis of the pin-like control element 31 in the disassembly position of FIG. 11 and thereby the pin-like control element 31 can be pulled out.

Figure 12:
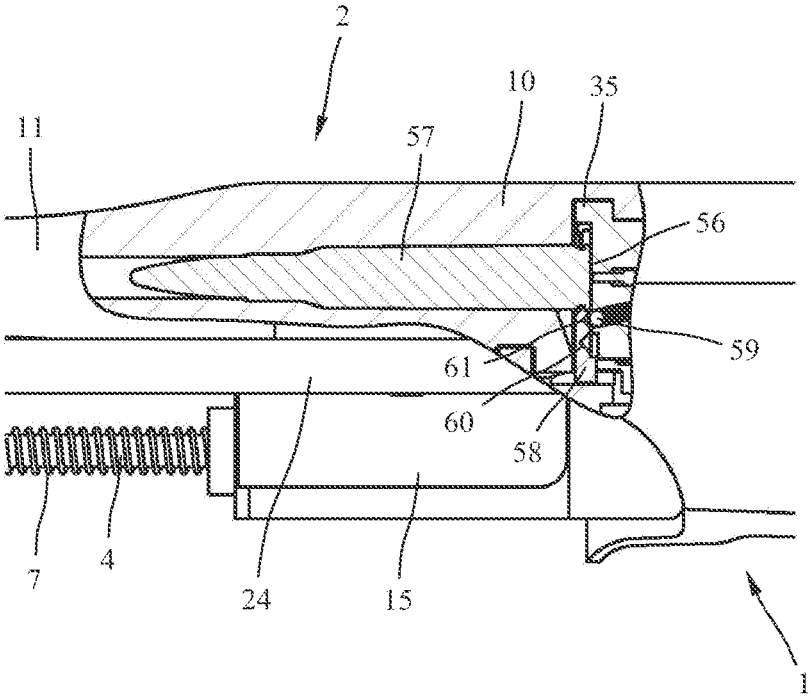
FIG. 12 shows a partial longitudinal section of the rifle in the area of the chamber with the slide element in a locked position.
Figure 13:
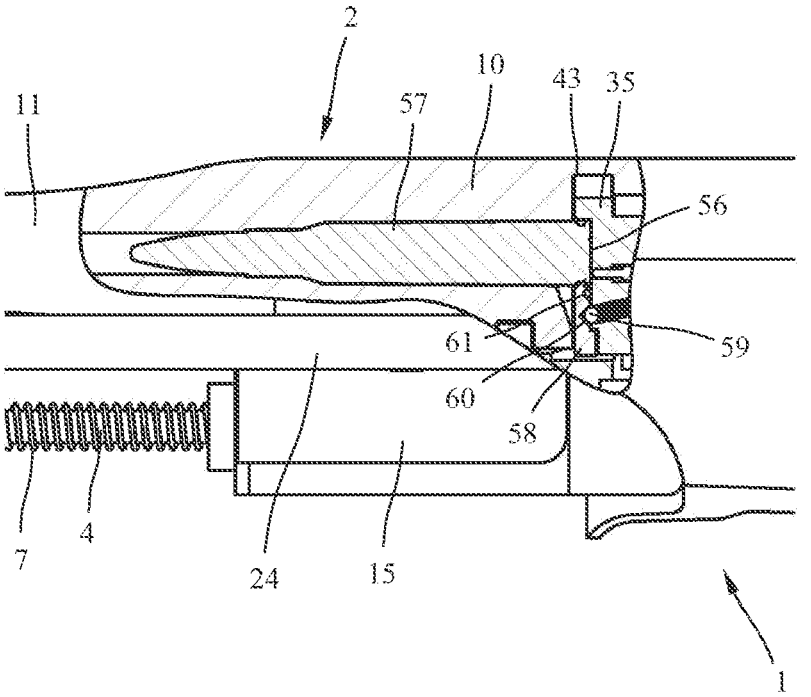
FIG. 13 shows a partial longitudinal section of the rifle in the area of the chamber with the slide element in an unlocked position.

It is apparent from FIGS. 12 and 13 that a radially movable cartridge holder 58 is arranged on the front side of the slide element 6 facing the cartridge head 56 of the cartridge 57. The cartridge holder 58 movable at right angles to the longitudinal axis of the slide element 6 can be moved between two detent positions with a detent ball 59 loaded by a spring and arranged in the slide element 6 and two detents 60 and 61 on the inside of the cartridge holder 58. The cartridge 57 is held by the cartridge holder 58 at the level of the chamber when the slide element 6 moves across the longitudinal axis of the barrel between the upper, locked position depicted in FIG. 12 and the lower, unlocked position depicted in FIG. 13.

Figure 14:
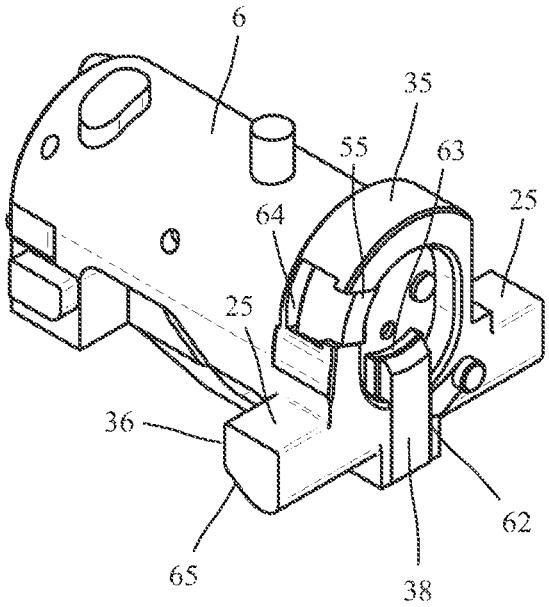
FIG. 14 shows the slide element in a perspective view from the front.

The cartridge holder 58 is guided to move according to FIG. 14 in a radial groove 62 on the front side of the slide element 6 and has a support surface 63 on its radial inner end for support on the bottom of the cartridge head 56. The ejector 55 is also guided to move radially in another radial groove 64 on the front side of slide element 6.

The gas-operated semiautomatic rifle described above functions as follows:

During the firing of a shot, part of the powder gas is passed through the gas extraction hole 19 from the rifle barrel 2 into gas cylinder 18. Through the diversion of gas pressure into the gas cylinder 18, the piston 20 is forced rearward, when viewed in the firing direction. The slide operating mechanism 5 with the support 22 and two push rods 24 is then also pushed rearward against the force of slide spring 7. Due to the rearward movement of the two push rods 24, the slide element 6 can be moved downwardly so that the locking block 35 can reach the rifle barrel 2 from the locking groove 43 and the slide element 6 can open the chamber in the rifle barrel 2 to the rear. During backward movement of the slide element 6, the empty cartridge is ejected via the ejector opening 12 and the lock is tightened. A new cartridge can then be brought to the level of the chamber via the magazine spring of a magazine. The slide element 6 is forced forward by the slide spring 7 via the slide operating mechanism 5 with support 22 and the two push rods 24, and a new cartridge is pushed into the chamber. The slide element 6 reaches the locked position again via the locking ramps 27 on the push rods 24, and the slide is closed. To facilitate movement of the slide element 6 into the locked position, slope 65, apparent in FIG. 4, with a slope corresponding to the locking ramps 27 can be provided on the shoulders 25.

For disassembly of the rifle barrel 2 in the gas-operated semiautomatic rifle described above, the two sleeve-like nuts 16, inaccessible from the bottom of slide housing 1 and provided with an interior hexagon, can be simply loosened by means of an Allen wrench. The entire rifle barrel 2 can then be easily removed upwardly. No prior disassembly of the front shaft 3 is required. When the rifle barrel 2 is removed, the safety pin 48 of the disassembly safety 47 also reaches the upper disassembly position, so that the pin-like control element 31 can be pulled out via the slide handle 32 and the slide element 6 thereby disassembled.

For assembly of the rifle barrel 2, this must merely be positioned on the slide housing 1 with the front shaft 3 fastened via the guide rod 4 so that the two holding pins 13 enter the holes 14 provided for them in the support part 15 of the slide housing 1 and the gas extraction block 17 reaches the receptacle 33 of the support 22 of the slide operating mechanism guided on guide rod 4. By tightening nut 16, the rifle barrel 2 is then fixed. In this way, particularly rapid and simple assembly and disassembly of barrel 2 is made possible. When the rifle barrel 2 is mounted, the safety pin 48 of the disassembly safety 47 is situated in the lower safety position where the pulling out of the pin-like control element 31 is prevented.

The disclosure is not restricted to the gas-operated semiautomatic rifle described above. It is correspondingly also usable in other automatic rifles, repeating rifles or other rifles.

What is claimed is:

1. A slide for a rifle comprising:

a slide-operating mechanism movable in a longitudinal direction of the rifle;

a slide element movable by the slide-operating mechanism between an upper, locked position and a lower, unlocked position;

a control element connecting the slide-operating mechanism to the slide element, the control element movable transversely to the slide element; and an unlocking ramp arranged on a control opening in the slide element, the unlocking ramp extending transversely through the slide element;

wherein the control element and the unlocking ramp cooperate with the slide element for displacement of the slide element between the upper, locked position and the lower, unlocked position.

2. The slide according to claim 1, wherein the control element is arranged to extend through the control opening in the slide element.

3. The slide according to claim 1, wherein the control element is a connector.

4. The slide according to claim 3, wherein the connector is a pin arranged for assembly and disassembly of the control element from an outside of the rifle.

5. The slide according to claim 1, further comprising a slide handle arranged on the control element.

6. The slide according to claim 1, wherein the slide-operating mechanism comprises two parallel push rods.

7. The slide according to claim 6, wherein the control element is arranged between the two parallel push rods.

8. The slide according to claim 7, further comprising a disassembly safety arranged in one of the two parallel push rods, the disassembly safety preventing undesired disassembly of the control element.

9. The slide according to claim 8, wherein the disassembly safety includes a safety pin arranged in a hole in a push rod at right angles to the control element, the safety pin movable within the hole guided by a lateral longitudinal groove and a holding pin perpendicular thereto.

10. The slide according to claim 9, wherein the safety pin is movable between a safety position holding the control element and a disassembly position releasing the control element.

11. The slide according to claim 10, wherein the disassembly safety further comprises a compression spring, the compression spring forcing the safety pin into the disassembly position.

12. The slide according to claim 6, wherein the slide element further comprises laterally-protruding shoulders, the laterally-protruding shoulders cooperating with locking ramps on the two parallel push rods to move the slide element into the upper, locked position.

13. The slide according to claim 1, further comprising a radially-movable cartridge holder arranged on the slide element.

14. A rifle comprising:

a slide housing;

a barrel releaseably fastened to the slide housing; and the slide according to claim 1.

15. The rifle according to claim 14, wherein the slide-operating mechanism is arranged to move between upper guide surfaces on the slide housing and lower guide surfaces on the barrel.

16. The rifle according to claim 14, wherein the barrel further comprises a rear part mounted on the slide housing and a front part freely protruding from the slide housing.

17. A slide for a rifle comprising:

a slide-operating mechanism including two parallel push rods and movable in a longitudinal direction of the rifle;

a slide element movable by the slide-operating mechanism between an upper, locked position and a lower, unlocked position;

a control element arranged between the two parallel push rods of the slide-operating mechanism and connecting the slide-operating mechanism to the slide element, the control element movable transversely to the slide element; and a disassembly safety arranged in one of the two parallel push rods, the disassembly safety preventing undesired disassembly of the control element;

wherein the slide element cooperates with the control element for displacement of the slide element between the upper, locked position and the lower, unlocked position.

18. The slide according to claim 17, wherein the disassembly safety includes a safety pin arranged in a hole in a push rod at right angles to the control element, the safety pin movable within the hole guided by a lateral longitudinal groove and a holding pin perpendicular thereto.

19. The slide according to claim 18, wherein the safety pin is movable between a safety position holding the control element and a disassembly position releasing the control element.

20. A rifle comprising:

a slide housing;

a barrel releaseably fastened to the slide housing; and the slide according to claim 17.

* * * * *